United States Patent [19]

Jung

[11] 4,043,283

[45] Aug. 23, 1977

[54] SEWING APPARATUS EMPLOYING TWIN NEEDLES

[75] Inventor: Wilhelm H. Jung, Mechanicsville, Va.

[73] Assignee: AMF Incorporated, White Plains, N.Y.

[21] Appl. No.: 750,037

[22] Filed: Dec. 13, 1976

Related U.S. Application Data

[63] Continuation-in-part of Ser. No. 596,324, July 17, 1975, abandoned.

[51] Int. Cl.[2] ..... D05B 1/08

[52] U.S. Cl. ..... 112/163

[58] Field of Search ..... 112/163–167, 112/104, 231, 232, 185, 102, 252, 121.27, 93

[56] References Cited

U.S. PATENT DOCUMENTS

| | | | |
|---|---|---|---|
| 1,574,122 | 2/1926 | Sharaf | 112/163 |
| 2,563,916 | 8/1951 | Brussell | 112/163 |
| 3,807,331 | 4/1974 | Simpson | 112/163 X |

*Primary Examiner*—G. V. Larkin

*Attorney, Agent, or Firm*—George W. Price; Charles J. Worth

[57] ABSTRACT

A sewing head employing twin needles for use with a material feed assembly at a sewing station, employing a linkage drive configuration enabling original rotary motion to be converted into linear rather than arcuate during formation of tacks. The same drive source is employed for both longitudinal and lateral motion, with a movable link added into the main feed link assembly. By means of a guide member, one portion of the main drive is confined to longitudinal motion only, while the other portion is free to go through the lateral motion separately. By employing an additional movable link and designing the main feed link as a two part link, while at the same time employing the same drive source for longitudinal and lateral motion, it is possible to achieve the necessary linear parallel motion. By the aforementioned arrangement, the drive link achieves linear motion and provides for a uniform tacking pattern for both needles.

Spacing between tacks can be varied by horizontal adjustment of the needle-bobbin assemblies.

6 Claims, 5 Drawing Figures

SEWING APPARATUS EMPLOYING TWIN NEEDLES

The present invention is a continuation-in-part of my previously filed patent application entitled Sewing Apparatus Employing Twin Needles, Ser. No. 596,324 filed July 17, 1975 and now abandoned.

The present invention is directed to an improved sewing machine head apparatus. More particularly, the invention is directed to a twin needle sewing apparatus with means for adjustable needle spacing.

The inventive apparatus relates to a pair of sewing needles which are disposed in a sewing machine head for tandem movement through a suitable linkage assembly. The use of parallel needles on a sewing machine head for tandem movement has specific applicability to the tack sewing operation, for example in the attachment of belt loops to trouser waist bands or where reinforcement at the corners of a patch pocket to a garment face may be required.

The need for increasing the speed and efficiency of sewing operations is well established. Obviously, if instead of two separate steps in tacking or sewing, the operator can, by suitable adjustment perform the same function in one operation, the overall efficiency is increased and time for the manufacturing step is substantially decreased. Furthermore, if this can be carried out without the need for elaborate and unduly complicated mechanical systems in which multiple needles are employed, the overall cost involved in manufacturing such an apparatus can be maintained at a reasonable level.

In carrying out the design rationale, from the traditional single needle tacker to a twin needle tacker, it is essential that a number of important design parameters be considered so as to assure uniformity of needle stroke in the longitudinal direction, i.e., as between inner and outer tacks. Failure to account for these factors can result in two tacks which are not uniform and do not align with respect to one another. This will be explained hereinafter in some detail.

In studying the prior art, it has been found that the prior patents, with minor exception cover one form or another of guide means for providing lateral and longitudinal movement in a straight line. However, in all instances, the prior patents relate to single needle machines wherein the ultimate movement is originally derived from some type of rotary motion. In all cases, however, none of the prior art discloses the concept as described with respect to multiple needles.

One of the important reasons for employing the linkage mechanism of the present invention in the manner as set forth hereinbelow, concerns itself with the ability of sewing needles to provide spaced tacks having a uniform and predefined characteristic with respect to one another and a relation with the pieces of material to be joined. The concepts employed in the present invention uses translatory motion of a non-curvilinear nature, that is, non-arcuate movement of the driving members in the longitudinal direction of the pair of tacks being formed.

For illustrative purposes, when employing the apparatus of the invention to tack the two end points of a belt loop onto a trouser waist band, the resultant tacks will exhibit eccentricity with respect to one another, unless the ultimate movement of the material feed mechanism is linear and not arcuate. Within the context of existing sewing machine heads, the present invention provides a means of modification and an improvement to achieve a high quality twin tack.

While the present invention considers the mounting of the respective bobbins opposite to one another as the preferred approach it is to be understood that other approaches can be successfully employed. For use in the present invention the mounting distance between the two respective bobbins is maintained at 2.50 inches. However, this distance may be altered to a narrower margin.

In evaluating and employing a standard single needle tacker, one is faced with the inherent problem of the circular motion path of the material feed. This in turn necessitates a restructuring of the drive source so as to provide linear motion and a uniform bar tack for both needles.

For an example, under a conventional set-up where the drive source is non-linear, when producing a 0.375 inch long and 0.125 wide bar tack, through a feed linkage driven by a cam through predefined lateral and longitudinal motion with the needles 2.50 inches apart, the circular path of the feed linkage produces two irregular bar tacks. Under the aforementioned conditions, the right of center tack measured 0.344 inches (less than the desired 0.375 inches) and the left of center tack measured 0.406 inches (larger than the 0.375 inches). Obviously, this type of irregularity was not acceptable and successive testing indicated that a disparity of the type shown above was due to the circular path motion of the material feed with respect to the fixed position of the stitching needles.

In the present invention, the same drive source is employed for both longitudinal and lateral motion, with a movable link added into the main feed length assembly. By means of a guide member, one portion of the main drive is confined to longitudinal motion only, while the other portion is free to go through the lateral motion separately. By employing an additional movable link and designing the main feed link as a two part link, while at the same time employing the same drive source for longitudinal and lateral motion, it is possible to achieve the necessary linear parallel motion. A guide which forms the first member of the main drive link is confined to longitudinal motion, whereas, the second member is free to move through lateral motion separately.

The principal features of the invention are directed to an apparatus for use in a sewing machine employed in the manufacture of two simultaneous tacks formed by joining a first unit of material to a second unit of material, after both have been fed into a sewing station, including: a sewing machine head; said sewing machine head being defined by first and second independently driven sewing needles spaced apart with respect to one another in a vertical plane, each of said needles depending from first and second supporting members, said needles being movable in concert with respect to one another and to first and second units of material in said sewing station: needle adjusting means adapted to longitudinally displace said first supporting member with respect to said second supporting member in accordance with a predefined needle-to-needle distance, material guide means supported about said pair of needles for positioning said first unit of material with respect to said second unit of material, prior to initiating the movement of said pair of spaced apart sewing needles; first and second bobbins having associated first and second shuttle means, being adapted to cooperatively act with said pair of spaced apart sewing needles to form a plurality of stitches for joining said first and second units of material; material feed means disposed in proximity to said sewing machine, being defined by interconnecting members driven to control longitudinal and lateral movement of first and second units of material during movement of said needles; and drive means interconnecting each of said bobbins through shaft means, for operating said first and second bobbin shuttle means in synchronization the respect to the movement of said needles.

Accordingly, it is the main object of the present invention to overcome the disadvantages of the prior art.

Still another object of the present invention is to provide an apparatus for directing multiple needles to uniformly tack in tandem with respect to one another and being adjustably spaced with respect to one another.

Still another feature of the present invention is to provide an apparatus for sewing inner and outer tacks of like character.

A further object of the invention is to provide a sewing machine head assembly having twin needle capability which is convertible to single needle capability.

Other objects and advantages of the present invention will be more clearly understood with reference to the accompanying specification, claims and drawings.

IN THE DRAWINGS

Figure 1:
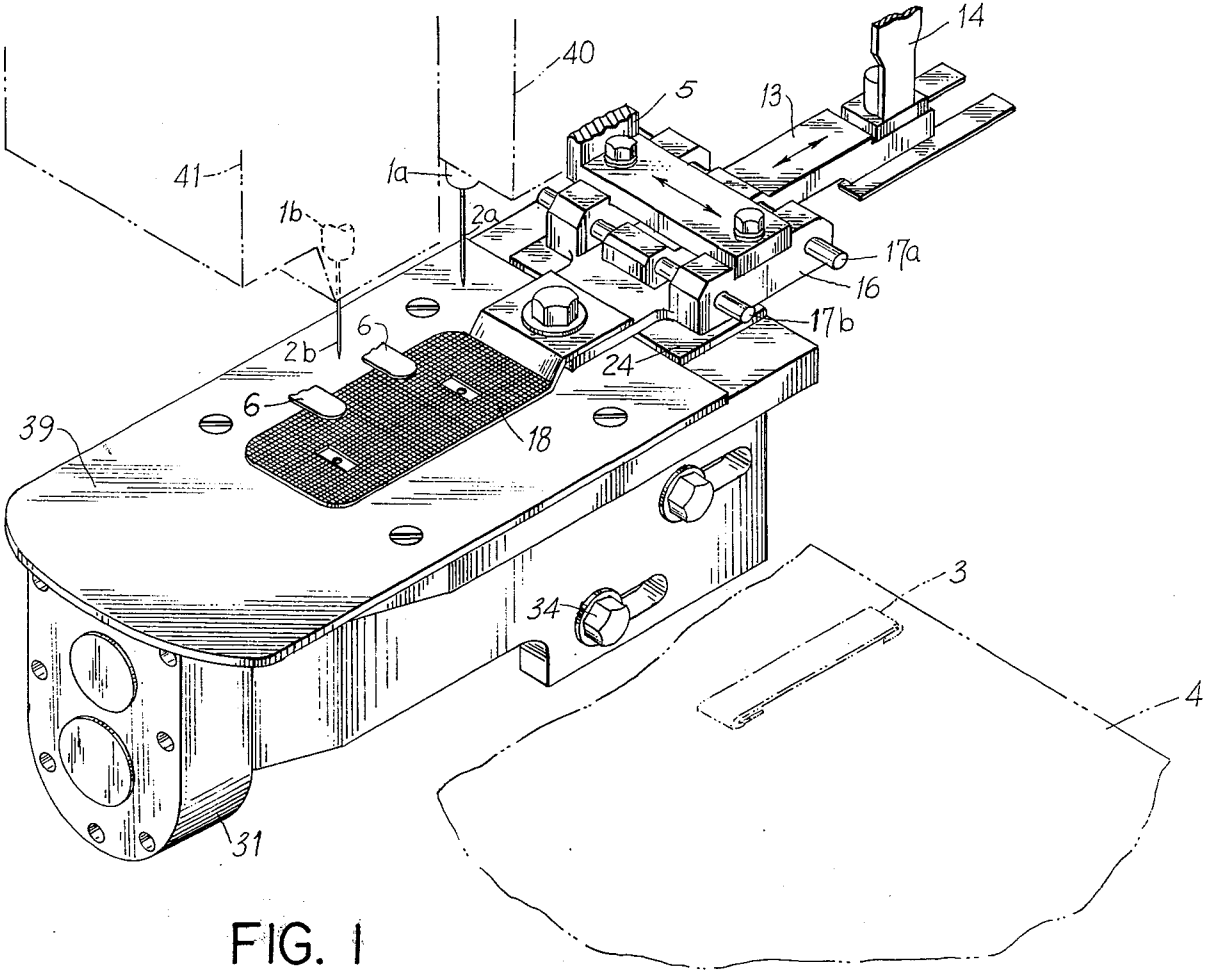
FIG. 1 is a perspective view in partial cross-section illustrating the twin needle assembly of the present invention.

According to FIG. 1, the present invention is provided with two movable needle bars 1*a*, 1*b* having needles 2*a*, 2*b* affixed thereto and mounted and spaced apart from one another. Needle bars 1*a*, 1*b* are caused to move in a vertical direction in tandem means to be described hereinafter and are constrained from rotational movement by means of a guide assembly employing a clamp having a slide affixed thereto for sliding within a slot (not shown). As the sewing operation begins, the articles to be sewn i.e., consisting of a trouser loop 3 positioned on a waist band 4, is clamped in position at the sewing station by causing clamp assembly 5 (see FIG. 2) through pneumatic means (not shown) to move downwardly such that the loop 3 is fixed in position through the action of a pair of spaced fingers 6 which are at the lower portion of the clamp assembly 5 and are disposed within the distance separating the needles 2*a*, 2*b* (see FIG. 2). At this point during the operation, the needles 2*a*, 2*b* are in the uppermost position.

Figure 5:
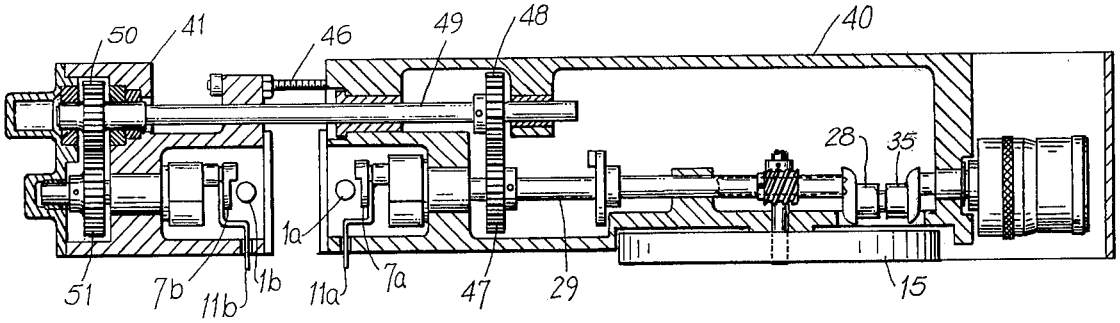
FIG. 5 is a partial sectional view of the drive mechanism and needle housing employed with the present invention.

Once the articles to be sewn are positioned, the sewing cycle is initiated and the needles are urged to move downwardly in a vertical direction through the action of needle bar drive assemblies 7*a*, 7*b* (see FIG. 5). These drive assemblies are of a conventional sewing machine needle bar drive type. A pair of threads 8*a*, 8*b* (see FIG. 2) are fed into the sewing station via a pair of tensioning members 10*a*, 10*b* and into thread pullers 11*a*, 11*b* from whence the threads 8*a*, 8*b* are guided into each of the respective needles 2*a*, 2*b*. As the needle bars 1*a*, 1*b* move downward, the needles 2*a*, 2*b* are caused to penetrate the loop 3 and waist band 4 to interlock with the oscillating bobbins 12*a*, 12*b* (see FIG. 3); at this point a lock stitch is formed at each end of the belt loop. The above operation is continued until the desired number of stitches are made at which point the sewing cycle is at an end. In order to form a proper tack, it is necessary that the loop 3 and waist band 4 while restrained by clamp assembly 5 and fingers 6 move in a lateral direction as each progressive stitch is made and simultaneously move in the longitudinal direction, so as to give the stitch a prescribed width.

FEED DRIVE ASSEMBLY

Figure 2:
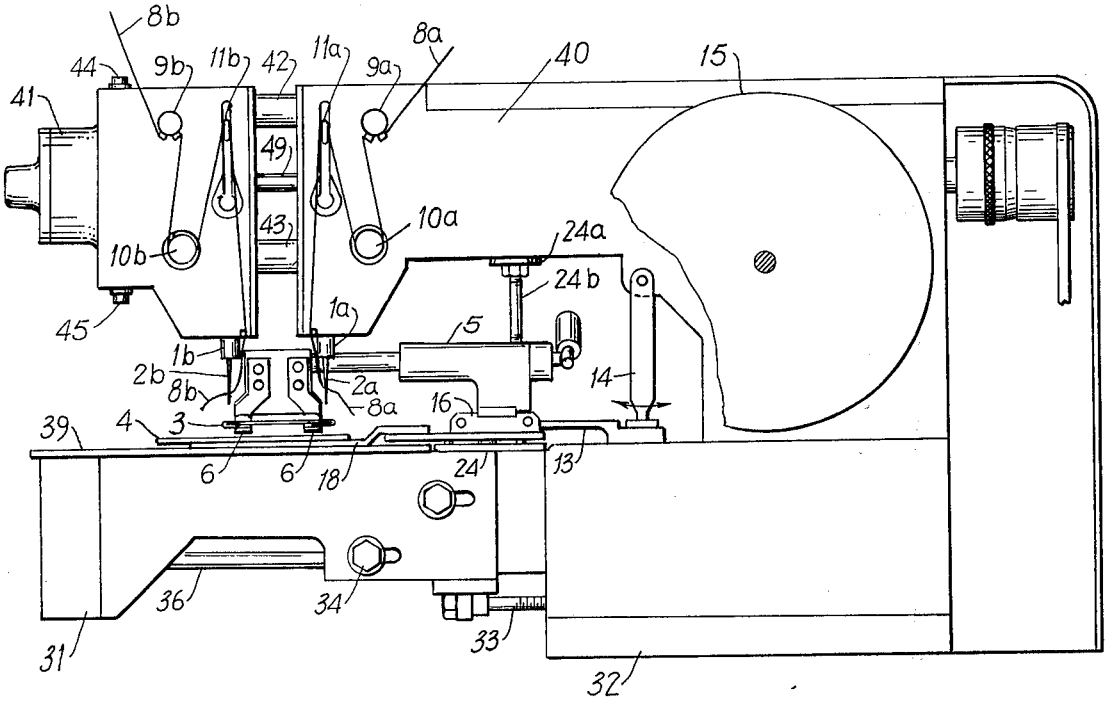
FIG. 2 is a profile view of the invention illustrating the use of the twin needle assembly mounted in a sewing machine head.

During the sewing cycle, longitudinal motion is achieved through link 13 mounted at 14 being driven by a cam operated feed drive 15 (see FIGS. 2 and 5).

Clamp assembly 5 mounted to a feed plate 16 joined with lower clamp plate 18 is connected to drive link 13 by rods 17*a*, 17*b* to bring about the logitudinal motion of the link 13.

The feed plate 16 is also connected to a lateral drive link 19 (FIG. 3) which is driven by a cam drive 20. Lateral motion is imparted to clamp assembly 5 (which includes feed plate 16 and lower clamp plate 18) through a connecting pin 21 affixed to drive link 19. During this step, the arcuate motion of drive link 19 is translated through pin 21 into lateral linear motion imparted to the complete material feed assembly including clamp assembly 5, feed plate 16 and lower clamp plate 18. The feed assembly which includes feed plate 16, lower clamp plate 18 and clamp assembly 5 is constrained from moving vertically during the sewing operation by means of a sliding plate 24 that is mounted to the top surface of lower frame 32. In addition, a bearing post 24*b* is mounted to clamp assembly 5 at one end and to pressure plate 24*a* at the opposite end, so that the feed assembly is free to slide in a horizontal plane but constrained from vertical movement. Link 13 is affixed to a slide 22 movable only in a longitudinal direction within a slot 23 formed on lower frame. As a result, the link 13 can only transverse longitudinally and is prevented from moving in an arcuate direction.

BOBBIN DRIVE ASSEMBLY

Figure 3:
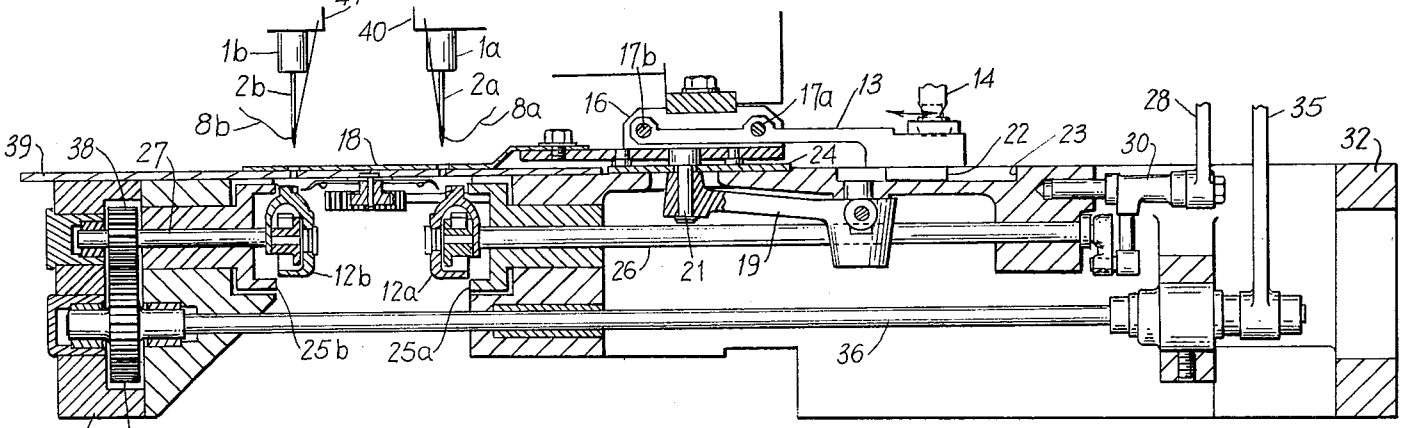
FIG. 3 is a partial sectional view of the drive mechanism and bobbin housing employed with the present invention.
Figure 4:
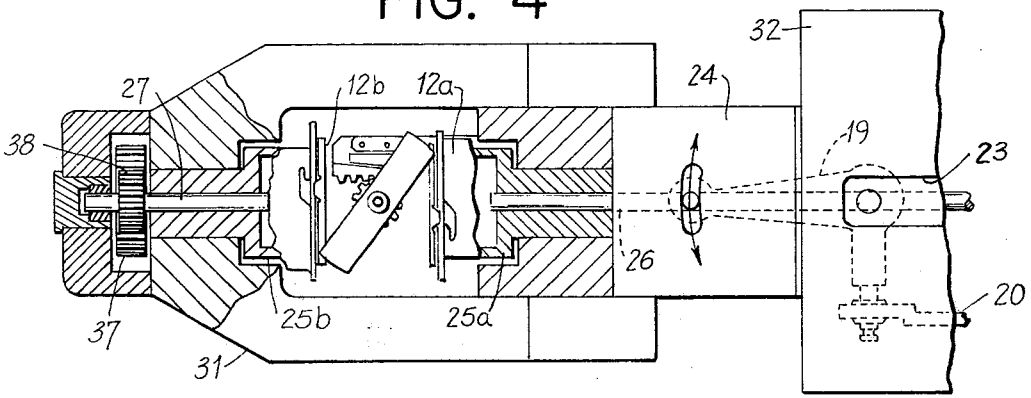
FIG. 4 is a top view of the bobbin housing and drive shown in FIG. 3 with the throat plate and feed linkage removed.

The bobbin assembly comprises bobbins 12*a*, 12*b* and associated casing (not shown) placed in a shuttle which travels in a race and is confined therein, all of which is mounted within a bobbin housing 25*a* 25*b* (FIG. 3). More specifically the bobbins are defined by rear bobbin 12*a* and front bobbin 12*b* each of which is driven through a drive shafts 26, 27 respectively.

The rear bobbin 12*a* is mounted in alignment with rear needle 2*a* to co-act therewith in a conventional manner as would be the case for any standard commercially available lockstitch tacker. More specifically, a driving rod 28 is connected at one end to crankshaft 29 and the opposite end is coupled to an intermediate link 30. This link 30 in turn oscillates and transmits oscillatory motion to the rear bobbin drive shaft 26. Another function of the link 30 is to multiply arcuate motion induced by crankshaft 29 at a ratio 1:2.125 from approximately 100° to 212.5° of arcuate motion. Rear bobbin drive shaft 26 is directly connected to the rear bobbin 12*a*, and therefore, drives same in an oscillating fashion. Another bobbin, the front bobbin 12*b* is mounted in alignment with the front needle 2*b* in order to interact with it. The front bobbin 12*b* and associated housing 25*b* are disposed in a separate, self-contained frame 31. The complete frame 31 is mounted to lower frame 32 in such a way that front bobbin 12*b* is directed toward rear bobbin 12*a* and also is in line with bobbin drive shaft 26. The front bobbin frame 31 is secured against misalignment by a pair of stationary keys (not shown). Adjustment between tacks is accomplished by moving front bobbin 12*b* toward rear bobbin 12*a* through an adjusting screw 33. After adjustment has been completed, the front bobbin frame 31 is locked in place by screws 34. The front bobbin 12*b* is driven by adding one additional connecting rod 35 to the crankshaft 29. The opposite end of connecting rod 35 is coupled to a front bobbin jack shaft 36 in order to produce an oscillating motion. By means of a set of helical gears 37, 38 with a ratio of 1:2125, oscillating motion is transferred to the front bobbin 12*b* with a proper amount of arcuate travel. The end of bobbin jack shaft 36 which receives helical gear 37, is splined and therefore permits helical gear 37 to slide freely in an axial direction within a prescribed adjustment range.

An interchangeable throatplate 39 is mounted on frame 31 and is formed to accept a predefined needle spacing as determined by operating conditions.

NEEDLE DRIVE ASSEMBLY

Needles 1*a*, 1*b* which cooperate with respective bobbins 12*a*, 12*b* are part of an overall needle drive assembly. The assembly is formed of an upper relatively large frame 40 (FIG. 2) which houses the drive components for all segments of the machine, including crankshaft 29. Crankshaft 29 rotates in a counterclockwise direction (viewed from drive input end) and is connected to needle bar drive assembly 7*a*. As the crankshaft 29 rotates, the needle bar 1*a* is caused to reciprocate through the action of the needle bar drive assembly 7*a*. To achieve twin needle operation with adjustable spacing between needles 2*a*, 2*b*, a self-contained front needle bar 1*b* and its drive assembly 7*b* is adjustably mounted in front of rear needle bar 1*a* and in alignment with crankshaft 29. A separate front needle bar housing 41 is supported by a pair of rods 42, 43 which are secured to frame 40; the housing 41 serves to retain all of the front needle bar drive components. By loosening clamps 44, 45 which are part of housing 41, the drive unit is free to move along rods 42, 43 within a total predefined adjustment range. In effect this enables the setting of the needle spacing to be varied, for example, from a maximum of 2.50 to that of 1.50. Spacing adjustment between needles 2*a*, 2*b* is achieved by rotating adjusting screw 46 which is mounted on front needle bar housing 41. By moving screw 46 the housing 41 is urged to move toward rear needle bar 1*a*. The front needle bar 1*b* is driven from the crankshaft 29 through a pair of helical gears 47, 48 at a 1:1 ratio toward axially fixed jack shaft 49. The jack shaft 49 rotates and drives a second pair of helical gears 50, 51 mounted at the opposite end of the jack shaft 49, to thereby drive needle bar 1*a*. Helical gear 50 is fitted to a square sectioned end of the jack shaft 49 and is free to slide axially within specified range. When needle space adjustment is necessary, the helical gear 50 will be urged to move through the rotation of screw 46. Front needle bar 1*b* is driven in a reciprocating motion simultaneously in synchronization with the rear needle bar 1*a* through needle bar assembly 7*b*. In addition, each needle 2*a*, 2*b* is supplied with its own thread 8*a*, 8*b* drawn from spools mounted in proximity of the machine. These threads 8*a*, 8*b* are guided through conventional eyelets and tensioning members 9*a*, 9*b*; 10*a*, 10*b*, including thread pullers 11*a*, 11*b*.

It will be apparent to those skilled in the art from the preceding description, that certain changes may be made in the above apparatus without departing from the scope of the invention. It is intended that the descriptive matter above shall be interpreted as illustrative and in no way limiting, since all equivalents within the scope of the disclosure may be substituted and such substitution is intended.

What I claim is:

1. An apparatus for use in a sewing machine employed in the manufacture of two simultaneous tacks formed by joining a first unit of material to a second unit of material, after both have been fed into a sewing station including: a sewing machine head; said sewing machine head being defined by first and second independently driven sewing needles spaced apart with respect to one another in a vertical plane, each of said needles depending from first and second supporting members, said needles being movable in concert with respect to one another and to first and second units of material in said sewing station; needle adjusting means adapted to longitudinally displace said first supporting member with respect to said second supporting member in accordance with a predefined needle-to-needle distance, material guide means supported about said pair of needles for positioning said first unit of material with respect to said second unit of material, prior to initiating the movement of said pair of spaced apart sewing needles; first and second bobbins having associated first and second shuttle means, being adapted to cooperatively act with said pair of spaced apart sewing needles to form a plurality of stitches for joining said first and second units of material; material feed means disposed in proximity to said sewing machine, being defined by interconnecting members driven to control longitudinal and lateral movement of first and second units of material during movement of said needles; and drive means interconnecting each of said bobbins through shaft means, for operating said first and second bobbin shuttle means in synchronization the respect to the movement of said needles.

2. An apparatus as claimed in claim 1, wherein: said material feed means being provided with an elongated connecting member movable in a longitudinal direction relative to the motion of said sewing needles and being slidably connected to an intermediary link adapted to move in response thereto; and a connecting link connected to said intermediary link and said drive means for governing the lateral motion of said intermediary link.

3. An apparatus as claimed in claim 1, wherein said material feed means being defined by a feed plate having an extending clamp plate connected thereto for receiving said needles and a clamp assembly disposed above said feed plate, said material feed means being driven in a longitudinal direction through drive link means connected to said feed plate and in a lateral direction through said connecting link to be translated into lateral linear motion for said material feed means.

4. An apparatus as claimed in claim 2, wherein said first and second bobbins are driven by bobbin drive means, defined by first and second drive shafts movable with oscillatory motion through the urging of a connecting rod affixed at a first end to said intermediary link and at a second end to a crankshaft.

5. An apparatus as claimed in claim 4, wherein: said first bobbin is disposed in alignment with said second bobbin drive shaft means and said drive shaft means is driven through action of a connecting rod and said crankshaft, through a jackshaft having gear means affixed thereto.

6. An apparatus as claimed in claim 1, wherein: said first and second sewing needles being separately driven through respective first and second needle bar drive means connected to crankshaft means through gear means; said first needle bar drive means being disposed in front of said second needle bar drive means and said second needle bar drive means is disposed to slidably travel with respect to said first needle bar drive means for relative positioning therewith.

* * * * *